US006106366A

United States Patent [19]

Dixon et al.

[11] Patent Number: 6,106,366

[45] Date of Patent: Aug. 22, 2000

[54] LENS GRINDER

[75] Inventors: William L. Dixon, Bixby; Kimber W. Rarick, Muskogee, both of Okla.

[73] Assignee: Gerber Coburn Optical, Inc., South Windsor, Conn.

[21] Appl. No.: 09/182,133

[22] Filed: Oct. 29, 1998

[51] Int. Cl.[7] ..... B24B 13/00

[52] U.S. Cl. ..... 451/10; 451/11; 451/42; 451/140; 451/143; 451/218; 451/256

[58] Field of Search ..... 451/9, 10, 11, 451/42, 43, 120, 123, 136, 137, 140, 143, 213, 255, 256, 218

[56] References Cited

U.S. PATENT DOCUMENTS

| | | | |
|---|---|---|---|
| 1,630,253 | 5/1927 | Bugbee | 451/255 |
| 3,353,303 | 11/1967 | Stern | 451/42 |
| 4,598,502 | 7/1986 | Lombard | 451/42 |
| 5,149,337 | 9/1992 | Watanabe | 451/43 |
| 5,482,495 | 1/1996 | Mayahara et al. | 451/42 |
| 5,951,375 | 9/1999 | Mandler | 451/42 |
| 5,951,376 | 9/1999 | Mandler | 451/43 |

*Primary Examiner*—Eileen P. Morgan

*Attorney, Agent, or Firm*—Frank J. Catalano

[57] ABSTRACT

A machine for cutting/grinding ophthalmic lenses has a lens spindle aligned on a vertical longitudinal axis and a tool spindle aligned on an angled axis in relation to the vertical axis. The lens blank is chucked on the upper end of the lens spindle and a tool is mounted on a lower end of the tool spindle. One motor rotates the lens spindle and the lens blank about the longitudinal axis and a second motor vertically reciprocates the lens spindle and the lens blank. A third motor rotates the tool spindle and the tool about the angled axis and a fourth motor linearly horizontally reciprocates the tool spindle and the tool. A microprocessor coordinates the rotation and reciprocation of the spindles to cause the tool to cut/grind the lens blank to a predetermined contour. The tool has a spherical grinding surface of diameter approximating but not greater than twice the radius of the steepest lens curvature to be cut/ground. Preferably, the angled axis intersects the vertical axis with an angle of approximately 125 to 145 degrees therebetween. Also preferably, the microprocessor causes the tool spindle to rotate at an angular velocity of approximately 8,000 revolutions per minute and the lens spindle to rotate at an angular velocity of approximately 20 to 150 revolutions per minute, so that the impact of the lens speed on the relative surface speed of the tool to the lens is negligible.

9 Claims, 3 Drawing Sheets

LENS GRINDER

BACKGROUND OF THE INVENTION

This invention relates generally to the making of ophthalmic lenses and more particularly concerns machines used to cut or grind ophthalmic lens blanks.

Ophthalmic lens lathing machines with high rates of production are now available in the marketplace. They produce lenses to very high finish standards. However, they are relatively large, heavy, complex and expensive machines. They require a high degree of calibration and tuning to attain the standard of quality they are capable of achieving. They are relatively difficult to maintain in service. Consequently, while they are excellent for high volume lens makers, they are generally not a practical choice for lens makers in a more modest market niche.

It is, therefore, an object of this invention to provide a lens making machine that is relatively small and lightweight. Another object of this invention is to provide a lens making machine that is highly reliable. A further object of this invention is to provide a lens making machine that is easily serviceable. Yet another object of this invention is to provide a lens making machine that is relatively easy to calibrate and tune in comparison to known machines. It is also an object of this invention to provide a lens making machine that is relatively inexpensive. Another object of this invention is to provide a lens making machine that produces lenses of good quality finish. A further object of this invention is to provide a lens making machine which has a reasonable production rate. In keeping with the above objects, it is also an object of this invention to provide a lens making machine that operates at relatively low rotational speeds in comparison to known machines. A further object of this invention is to provide a lens making machine that controls lens thickness as a function of lens movement only. A further object of this invention is to provide a lens making machine that is controlled by a relatively simple microprocessor.

SUMMARY OF THE INVENTION

In accordance with the invention, a machine for cutting or grinding ophthalmic lenses is provided in which the lens blank to be cut or ground is chucked to the upper end of a spindle which is aligned on a vertical longitudinal axis. One motor rotates the lens spindle and the chucked lens blank about the vertical longitudinal axis while another motor reciprocates the lens spindle and the chucked lens blank in a vertical direction. A cutting/grinding tool is mounted on the lower end of another spindle which is aligned on an axis angled with respect to the lens spindle. A third motor rotates the tool spindle and the tool about the angled axis while a fourth motor linearly horizontally reciprocates the tool spindle and the tool. A microprocessor coordinates the rotation and reciprocation of the spindles to cause the tool to cut or grind the lens blank in accordance with its predetermined contour. The tool has a spherical cutting or grinding surface of diameter approximating but not greater than twice the radius of the steepest lens curvature to be cut or ground. The steepest lens curvature now commonly used is 20 diopters and is determined by the equation $D=n-1/r$ where D is the diopter rating, n is the index of refraction of the lens to be cut or ground and r is the radius of the lens surface. Using tools made in standard diameters varying by 1/16", the corresponding metric diameters are as follows:

| Diameter in inches | Diameter in millimeters |
|---|---|
| 2 1/8 | 54.0 |
| 2 1/16 | 52.4 |
| 2 | 50.8 |
| 1 15/16 | 49.2 |
| 1 7/8 | 47.6 |
| 1 13/16 | 46.0 |
| 1 3/4 | 44.4 |

Reversing the equation, given an index n of 1.53, the radius r of a 20 diopter lens would be 26.5 millimeters and the diameter 53 millimeters. The optimal tool would, therefore, have a diameter of 2 1/16". A tool for a 22 diopter lens would have a diameter of not more than 48 millimeters, so the optimal tool would have a 1 5/16 inch diameter. It is anticipated that eventually 30 diopter lenses will be cut or ground using optimal tools of 1 3/8" diameter.

Preferably, the angle between the tool axis and the lens axis is approximately 125 to 145 degrees and most preferably 135 degrees and the microprocessor causes the tool spindle to rotate at an angular velocity of approximately 8,000 to 10,000 rpm and the lens spindle to rotate at an angular velocity of approximately 20 to 150 rpm. Aligning the tool spindle at the most preferred 45 degree angle or a 135 degree displacement from the lens spindle minimizes horizontal movement of the tool and averages the tool wear over the maximum surface area of the spherical grinder. It is this angled relationship which allows the use of a large diameter tool which approximates the steepest curve to be cut or ground into the lens, thus requiring minimal horizontal movement of the tool. Smaller tools are typically rotated in a range of 30,000 rpm and while the lenses must be rotated in a range of 4,000 rpm to provide a suitable relative surface speed.

Thus the large sphere lens cutter/grinder, by using a spherical tool more than three times the diameter of cutting/grinding tools presently used in the industry, operates at lower spindle speeds, applies lesser cutting/grinding forces to the lens and better distributes the forces applied to the lens.

By chucking the lens to a vertical axis spindle, support is easily accomplished without need for a base plate. The machine is therefore lightweight and fits in a small footprint.

To maintain a constant surface speed of the cutting/grinding tool on the lens, the angular velocity of the tool is decreased as the tool moves radially inwardly in relation to the lens. As the tool moves in one stroke from the outer to the inner portion of the lens, the lens reciprocates vertically in conformance to the complexity of the lens being ground. Thus, lens thickness is a function of lens movement in a vertical direction only. Since the lens movement is along a unidirectional thrust line, the possibility of error is minimized.

Since the cutting forces are lower than the forces of any known machine, lens blocking problems are greatly reduced and the lens chuck requires approximately one-half the gripping force of chucks of higher cutting force machines. Furthermore, the machine can make deep cuts in the range of one-half inch as opposed to making sixteen shallower cuts of 1/32 each as is done with presently known machines.

It is anticipated that carbide inserts will be used in the grinding tool for dry cutting plastic. A variety of other materials can be used for tools used in a wet cutting process. Diamond grinders will be used for grinding glass.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE INVENTION

Figure 1:
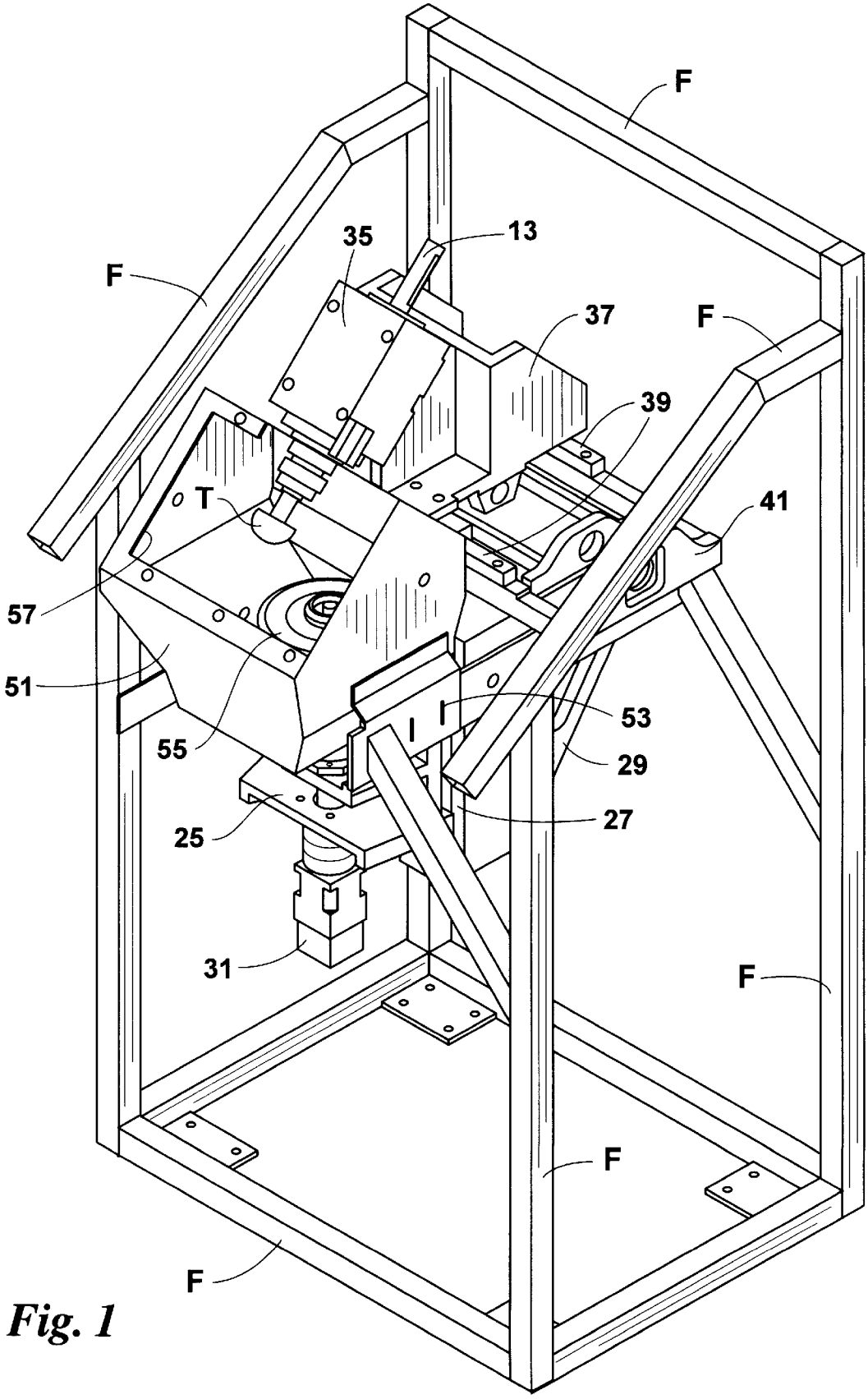
FIG. 1 is a perspective view of a preferred embodiment of the lens making components of the lens making machine mounted on a supporting frame.
Figure 2:
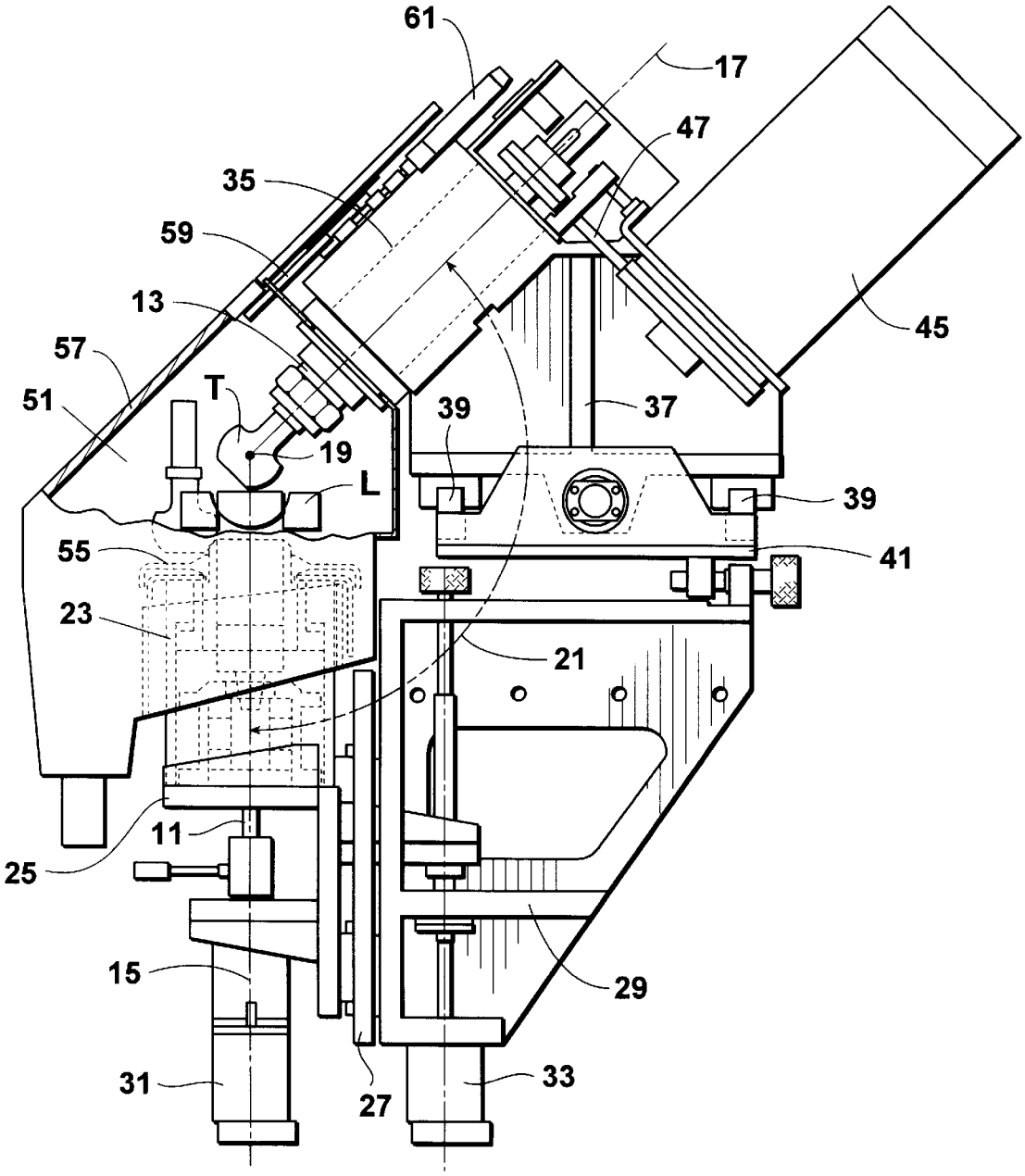
FIG. 2 is a side elevation view of the machine of FIG. 1.

Looking at FIGS. 1 and 2, a preferred embodiment of a machine for cutting/grinding a lens blank L to a predetermined contour using a tool T is illustrated. While the contour to be cut/ground into the lens blank L is not necessarily spherical, the tool T is spherically shaped and must have a diameter that is not greater than twice the radius of the steepest curvature to be cut/ground into the lens blank L.

As shown, the lens blank L is chucked to a lens spindle 11 and the tool T is mounted on a tool spindle 13. The lens spindle 11 has a vertical longitudinal central axis 15 and the tool spindle 13 has a longitudinal central axis 17. With the axes 15 and 17 aligned to intersect at the center 19 of the tool T, the angle 21 therebetween is in a range of approximately 125 to 145 degrees and preferably is 135 degrees, as shown. The lens spindle 11 is mounted for rotation about its longitudinal axis 15 in a lens spindle bearing assembly 23 which is in turn mounted on a Z carriage casting 25. The Z carriage casting 25 is slidably engaged on guide rails 27 which are mounted vertically on a Z base casting 29 which is in turn fixed to the machine frame F. Thus, the lens spindle 11 may rotate in the spindle bearing assembly 23 and reciprocate with the Z carriage casting 25 vertically on the guide rails 27. A motor 31 connected to the lower end of the lens spindle 11 provides the rotational drive for the lens spindle 11. Another motor 33 reciprocates the Z carriage casting 25 on the guide rails 27. The tool spindle 13 is mounted for rotation about its central axis 17 in a tool spindle bearing assembly 35 which is mounted on an X carriage casting 37. The X carriage casting 37 is in turn slidably mounted on guide rails 39 fixed horizontally on an X base casting 41 which is in turn fixed to the frame F of the machine. Thus, the tool spindle 13 may rotate in the tool spindle assembly 35 about its central axis 17 and reciprocate horizontally with the X carriage casting 37. A third motor 43 reciprocates the X carriage casting 37 on the guide rails 39 while a fourth motor 45 connected by a belt 47 to the upper end of the tool spindle 13 rotationally drives the tool spindle 13.

It is preferred that all four motors 31, 33, 43 and 45 be DC brushless motors with encoders. The structure of the spindle bearing assemblies 23 and 35 and the structure connecting the motors 31, 33, 43 and 45 to the spindles 11 and 13 and to the Z and X carriage castings 25 and 27 need no further explanation for the purposes of the present disclosure, such structural configurations being well known in the art.

The cutter/grinding area of the machine is enclosed in a chamber 51 which is connected to the frame F by brackets 53. A chuck assembly 55 on which the lens blank L will be mounted and which may be of any configuration known in the art is reciprocally and rotatively mounted on the upper end of the lens spindle 11. The chuck assembly 55 is situated in the lower portion of the chamber 51 with the lens spindle 11 extending through the bottom of the chamber 51. The tool T mounted on the tool spindle 13 is situated in the upper portion of the chamber 51 with the tool spindle 13 extending through a horizontal slot in an upper rear wall of the chamber 51. When the tool spindle axis 17 is horizontally aligned with the lens spindle axis 15, the spindle axes 15 and 17 intersect at the center 19 of the tool T. A user access opening 57 into the chamber 51 is covered by a sliding door 59 which is operated by an air cylinder 61. The opening 57 permits mounting and removal of the lens blank L on the chuck assembly 55 and replacement of the tool T.

As shown, the frame F supporting the machine components preferably includes tubular members arranged to form a rectangular base, tubular upright members extending vertically from the corners of the base, a horizontal top member connecting the rear uprights and downwardly angled members extending from the rear uprights to their corresponding front uprights to provide a tilted work face for the machine. Additional tubular members are angled inwardly from the uprights to support the base castings 29 and 41.

Figure 3:
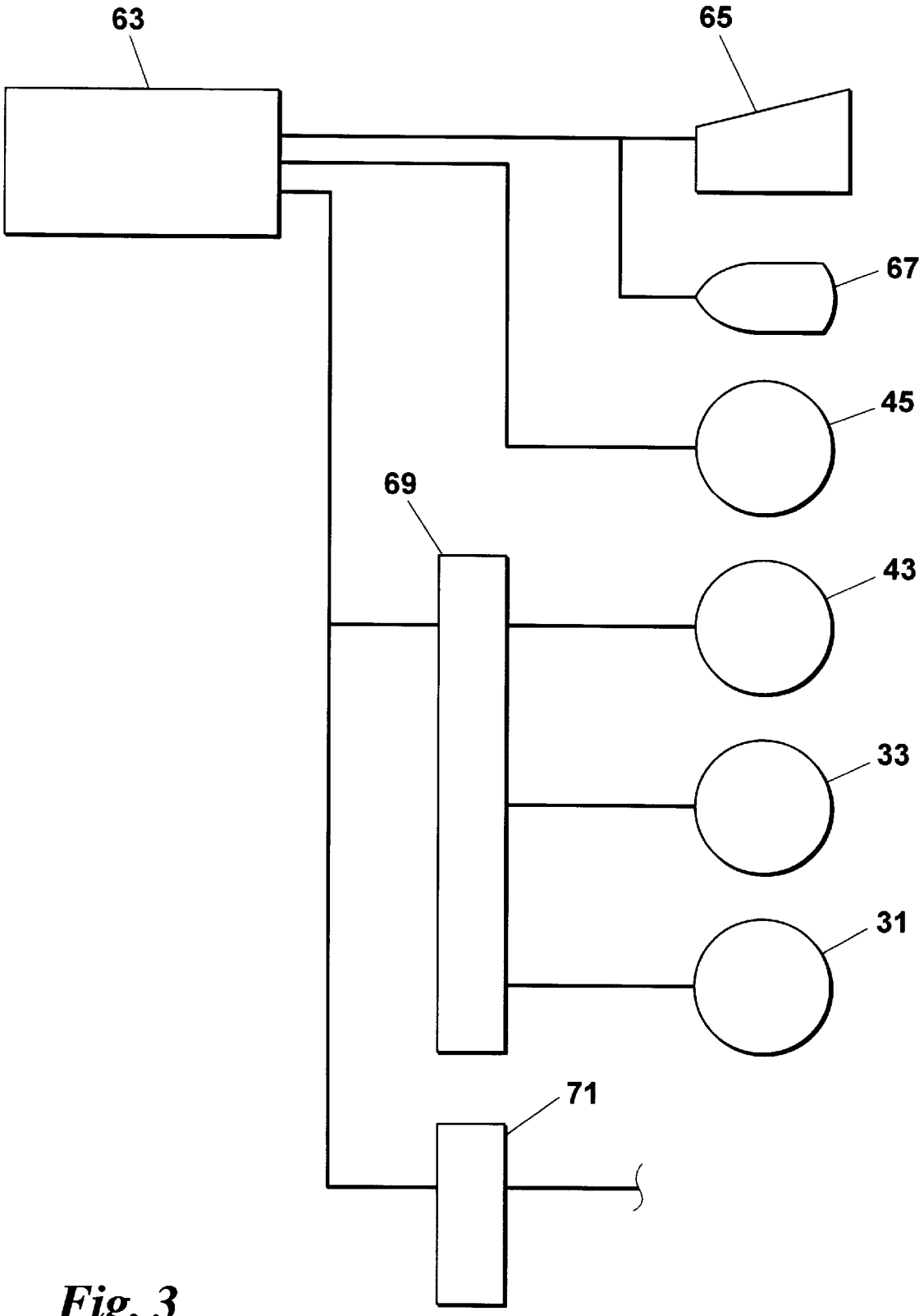
FIG. 3 is a block diagram illustrating the electrical interconnection of the lens making components of the lens making machine.

Turning now to FIG. 3, the machine includes a microprocessor 63 connected to a user interface including a keyboard 65 and a visual display 67 which will preferably be mounted in the slanted front face of the machine proximate the user access opening 57. The angular velocity of the tool spindle 13 is preferably constant, so the tool spindle drive motor 45 is connected directly to the microprocessor 63. The horizontal or X axis reciprocation of the tool spindle 13 and the angular velocity and vertical reciprocation of the lens spindle 11, however, are varied to control the contour to be cut/ground into the lens blank L. Therefore, the tool reciprocating motor 43 and the lens reciprocating and rotating motors 33 and 31 are connected to the microprocessor 63 through an I/O card 69. A second I/O card 71 may also be used to connect the microprocessor 63 to other equipment associated with the machine, such as swarf cutting equipment, a vacuum system, a water cooling system for glass grinding applications and pneumatic and hydraulic systems and the like (not shown). An outlet drain 73 is provided in the bottom of the chamber 51 for liquid coolant and waste material collected therewith to be ejected from the chamber 51.

Microprocessor control of cutting/grinding machines for ophthalmic lenses is well known. It is, however, of significance to the present invention that the motions controlled by the microprocessor 63 are limited to a constant tool rotational speed, a horizontal or X axis reciprocation of the tool T, a nominal rotational speed of the lens spindle 11 and a vertical reciprocation of the lens spindle 11. The only nonrotational movement of the lens spindle 11 is its vertical reciprocation. The simplicity of this operation further permits the preferred use of passive I/O cards 69 and 71. Most importantly, the above structural configuration enables the use of a tool having a diameter approximating but not greater than twice the radius of the steepest curvature to be cut/ground into the lens blank L. "Approximating" in this sense means within approximately 1/16 of twice the radius of the steepest curvature as compared with known tools having diameters about 1/3 the diameters of the present tools. Because of this tool dimension, which is made possible by the structural configuration hereinbefore explained, the advantages hereinbefore set forth are achieved.

Furthermore, because of the configuration of this machine, the same machine can be used to cut/grind both plastic and glass lenses. Efficient glass grinding requires relative tool to lens blank surface speeds in a range of 5,000 feet per minute. The large diameter tool T permits tool angular velocities in a range of 8 to 10,000 rotations per minute and lens angular velocities in a range of 20 to 150 revolutions per minute. Thus, the angular velocity of the lens is negligible when considered in terms of the relative surface speed desired for grinding glass. A single machine using the above angular velocity parameters can therefore be used to cut plastic and glass.

For dry cutting plastic, tools employing carbide inserts are preferable. In wet cutting processes, a variety of other materials can be used in the tools. Diamond grinders will be used for grinding glass in a wet process. The machine can be switched to either a wet or dry process by the user via the microprocessor user interface.

Thus, it is apparent that there has been provided, in accordance with the invention, a lens generating machine that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A machine for cutting/grinding an ophthalmic lens blank comprising:

a lens spindle aligned on a vertical longitudinal axis for supporting the lens blank at an upper end thereof;

means for rotating said lens spindle and the lens blank supported thereon about said longitudinal axis;

means for vertically reciprocating said lens spindle and the lens blank supported thereon;

a tool spindle aligned on an axis angled in relation to said vertical axis for supporting a cutting/grinding tool at a lower end thereof;

means for rotating said tool spindle and said cutting/grinding tool supported thereon about said angled axis;

means for linearly horizontally reciprocating said tool spindle and said cutting/grinding tool supported thereon; and a microprocessor for coordinating rotation and reciprocation of said spindles to cause said cutting/grinding tool to cut/grind the lens blank to a predetermined contour;

said cutting/grinding tool having a spherical cutting/grinding surface having a diameter approximating but not greater than twice a radius of a steepest curve of said predetermined contour.

2. A machine according to claim 1, said cutting/grinding tool have a diameter of approximately 1¼ to 2¼ inches.

3. A machine according to claim 1, said angled axis intersecting said vertical axis at an angle of approximately 125 to 145 degrees therebetween.

4. A machine according to claim 3, said angle being 135 degrees.

5. A machine according to claim 1, said microprocessor causing said tool spindle to rotate at an angular velocity of approximately 8,000 to 10,000 revolutions per minute.

6. A machine according to claim 5, said microprocessor causing said lens spindle to rotate at an angular velocity which is negligible in a determination of a relative surface speed of said tool on said lens.

7. A machine according to claim 6, said lens spindle angular velocity being approximately 20 to 150 revolutions per minute.

8. A machine according to claim 6, said relative surface speed being approximately 5,000 surface feet per minute.

9. A machine according to claim 1, said microprocessor being connected to said tool spindle reciprocating means, said lens spindle reciprocating means and said lens spindle rotating means by a passive input/output card.

* * * * *